US007731647B2

(12) United States Patent
Duwendag et al.

(10) Patent No.: US 7,731,647 B2
(45) Date of Patent: Jun. 8, 2010

(54) DEVICE FOR PLACING A PAPER BAG BOTTOM

(75) Inventors: Ruediger Duwendag, Lengerich (DE); Marco Daher, Wallenhorst (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/524,266

(22) PCT Filed: Aug. 29, 2003

(86) PCT No.: PCT/EP03/09663

§ 371 (c)(1),
(2), (4) Date: Feb. 11, 2005

(87) PCT Pub. No.: WO2004/033113

PCT Pub. Date: Apr. 22, 2004

(65) Prior Publication Data

US 2006/0048899 A1 Mar. 9, 2006

(30) Foreign Application Priority Data

| | | |
|---|---|---|
| Sep. 13, 2002 | (DE) | 102 42 539 |
| Sep. 13, 2002 | (DE) | 102 42 732 |
| Sep. 13, 2002 | (DE) | 102 43 230 |
| Mar. 5, 2003 | (DE) | 103 09 893 |

(51) Int. Cl.
*B31B 1/90* (2006.01)

(52) U.S. Cl. ..... 493/218; 493/221; 493/264; 493/285

(58) Field of Classification Search ..... 493/218, 493/219, 221, 264, 276, 285, 331, 334; 118/315, 118/324, 325, 410; 156/578; 222/319, 330, 222/336, 410, 485, 550
See application file for complete search history.

(56) References Cited

U.S. PATENT DOCUMENTS

| | | | | |
|---|---|---|---|---|
| 3,286,689 | A * | 11/1966 | Ziemba | 118/411 |
| 3,669,067 | A * | 6/1972 | Achermann et al. | 118/50 |
| 3,896,763 | A * | 7/1975 | Lau et al. | 118/50 |
| 4,156,398 | A * | 5/1979 | McDaniel | 118/704 |
| 4,157,149 | A * | 6/1979 | Moen | 222/486 |
| 4,256,526 | A * | 3/1981 | McDaniel | 156/295 |
| 4,343,259 | A * | 8/1982 | McConnel | 118/44 |

(Continued)

FOREIGN PATENT DOCUMENTS

| | | |
|---|---|---|
| DE | 81100 | 10/1894 |

(Continued)

*Primary Examiner*—Hemant M Desai
(74) *Attorney, Agent, or Firm*—Jacobson Holman PLLC

(57) ABSTRACT

A device for placing a paper bag bottom produces score lines on the ends of tubular segments which are used for producing bags, applies glue layers to the folded bottoms on the extremities of the tubular segments and/or to sheets for gluing them with the bottoms with the aid of gluers and connects and glues the folded bottoms and the sheets. The device has at least one gluer which includes at least one glue reservoir or at least one glue duct, the glue contained in the reservoir or in the duct being exposed to a pressure higher than ambient pressure. The glue reservoir or the glue duct is provided with at least one output orifice for applying the glue to the sheets and/or to the folded bottoms.

41 Claims, 12 Drawing Sheets

U.S. PATENT DOCUMENTS

| | | | | | |
|---|---|---|---|---|---|
| 4,430,147 | A * | 2/1984 | Harston et al. | 156/578 |
| 4,488,665 | A * | 12/1984 | Cocks et al. | 222/146.5 |
| 4,687,137 | A * | 8/1987 | Boger et al. | 239/124 |
| 4,874,451 | A * | 10/1989 | Boger et al. | 156/291 |
| 5,000,112 | A * | 3/1991 | Rothen et al. | 118/411 |
| 5,016,812 | A * | 5/1991 | Pedigrew | 229/132 |
| 5,647,948 | A * | 7/1997 | Paridis | 156/578 |
| 5,730,359 | A * | 3/1998 | Wurth | 239/66 |
| 5,740,963 | A * | 4/1998 | Riney et al. | 239/299 |
| 5,913,764 | A * | 6/1999 | Kolbe et al. | 493/218 |
| 6,342,264 | B1 * | 1/2002 | Raterman et al. | 427/8 |
| 6,368,409 | B1 | 4/2002 | Borsuk et al. | |
| 6,475,283 | B1 | 11/2002 | Koehn | |
| 6,673,152 | B2 * | 1/2004 | Guzzon et al. | 118/315 |
| 6,746,712 | B2 | 6/2004 | Hoffmann et al. | |
| 6,805,660 | B1 * | 10/2004 | Finch | 493/218 |
| 6,932,870 | B2 * | 8/2005 | Gunn et al. | 118/300 |
| 6,955,722 | B2 * | 10/2005 | Ackerman | 118/315 |
| 2002/0079327 | A1 | 6/2002 | Estelle et al. | |

FOREIGN PATENT DOCUMENTS

| | | | |
|---|---|---|---|
| DE | 1107062 | | 5/1961 |
| DE | 30 20 043 | A1 | 12/1981 |
| DE | 35 06 393 | A1 | 8/1986 |
| DE | 38 04 856 | A1 | 8/1989 |
| DE | 90 14 548 | U | 1/1991 |
| DE | 198 43 352 | A1 | 4/1999 |
| DE | 198 42 266 | A1 | 3/2000 |
| DE | 199 35 117 | A1 | 2/2001 |
| DE | 100 53 064 | A1 | 5/2001 |
| DE | 101 41 676 | A1 | 6/2002 |

* cited by examiner

PRIOR A

50

DEVICE FOR PLACING A PAPER BAG BOTTOM

This is a nationalization of PCT/EP03/009663 filed Aug. 29, 2003 and published in German.

BACKGROUND OF THE INVENTION

1. Field of the Invention

The invention concerns a device for placing a paper bag bottom that has connected and glued folded bottoms.

2. Description of the Prior Art

Devices of this kind are used for manufacturing different types of bags. These include cement bags that are usually manufactured as valve bags. For this purpose usually the bottom folding involves the use of valve sheets that are inserted in the bottom of the bag. However it is important to differentiate between pinch-, block- and cross bottoms. In the creation of cross bottom bags that is explained, for instance, in DE 090 145 48 U1 and DE 3020043 A1, special demands were placed on the gluing.

In all devices of this kind the bag bottoms are formed with the help of glue—usually starch glue. For this purpose either the folded bottoms or the valve sheets assigned to them or both the aforementioned elements to be glued are provided with a glue layer and subsequently merged together. Each of the bag components is glued usually by bringing a format part in contact with glue rollers or other glue storage or transmission components. The format part is attached to a rotating roller and is often also referred to as a plate. By rotating the glue roller, the format part is supplied with glue. As the glue roller continues to rotate, the format plate transfers the glue stored on it to the respective bag component to be glued.

For this purpose the format part is provided with characteristic peaks (ridges) that are adapted to a definite bag format. In order to manufacture bags with different measurements on the bottoming device the format parts are replaced.

The described type of glue application has stood the test of time in the devices for placing a paper bag bottom because it enables a clean application of large quantities of starch glue that is otherwise difficult to handle.

However, this method of glue transfer makes it necessary to make available and later clean many mechanical glue transfer components—such as for instance the plate roller and the format parts.

Therefore the task underlying the present invention is to make these components redundant.

SUMMARY OF THE INVENTION

The task is solved by the fact that at least one gluer that is equipped with at least one glue reservoir or at least one glue duct in which the glue is exposed to a pressure that is higher than the ambient pressure and whereby the at least one glue reservoir (21) or the at least one glue duct is provided with at least one glue output orifice through which the glue is directly applied on the sheets and/or the folded bottoms (1).

An advantageous design form of the present invention can carry out a glue transfer process on the components to be glued while at the same time preventing a component of the bottoming device that is carrying the glue, such as the glue reservoir or the glue duct, from touching the bag components. For this purpose the output orifices should be appropriately distanced from the parts to be glued. The glue can be properly sprayed against the parts to be glued. This contact-free glue application can prevent the contours of the format from being smeared and thus distorted by the contact.

However, the contours can be intentionally smeared by the components of the gluer. Particularly, if the glue application occurs not across the entire surface but instead for instance in the form of glue lines, the entire surface can be covered with glue by smearing the glue lines. This smearing is possible by a direct contact between the glue reservoir or the glue duct and the glue lines. However, as a rule, additional rollers contribute to a smearing or compression of the glue lines.

Another advantageous design form of the present invention features numerous output orifices that are provided at a glue application head.

Further examples of implementation of the present invention emanate from the graphic description and claims.

BRIEF DESCRIPTION OF THE DRAWINGS

The individual figures illustrate:

FIG. 5 *c*) Another side-view of the example of implementation of the present invention illustrated in FIG. 5*a*)

FIG. 7 *b*) An illustration of the glue duct from the valves to the output orifices in the example of the implementation of the application head illustrated in FIG. 7 *a*).

FIG. 7 *c*) An enlarged section from FIG. 7 *b*)

Furthermore, the individual figures illustrate:

The following figures illustrate not only glue application devices for cross bottom bags but also devices of prior art. The illustrated devices in accordance with the invention apply glue solely on bottom sheets 2. However they can also apply glue equally well on cross bottoms 1.

DETAILED DESCRIPTION OF THE PREFERRED EMBODIMENTS

Further scope of applicability of the present invention will become apparent from the detailed description given hereinafter. However, it should be understood that he detailed description and specific examples, while indicating preferred embodiments of the invention, are given by way of illustration only, since various changes and modifications within the spirit and scope of the invention will become apparent to those skilled in the art from this detailed description.

Figure 1:
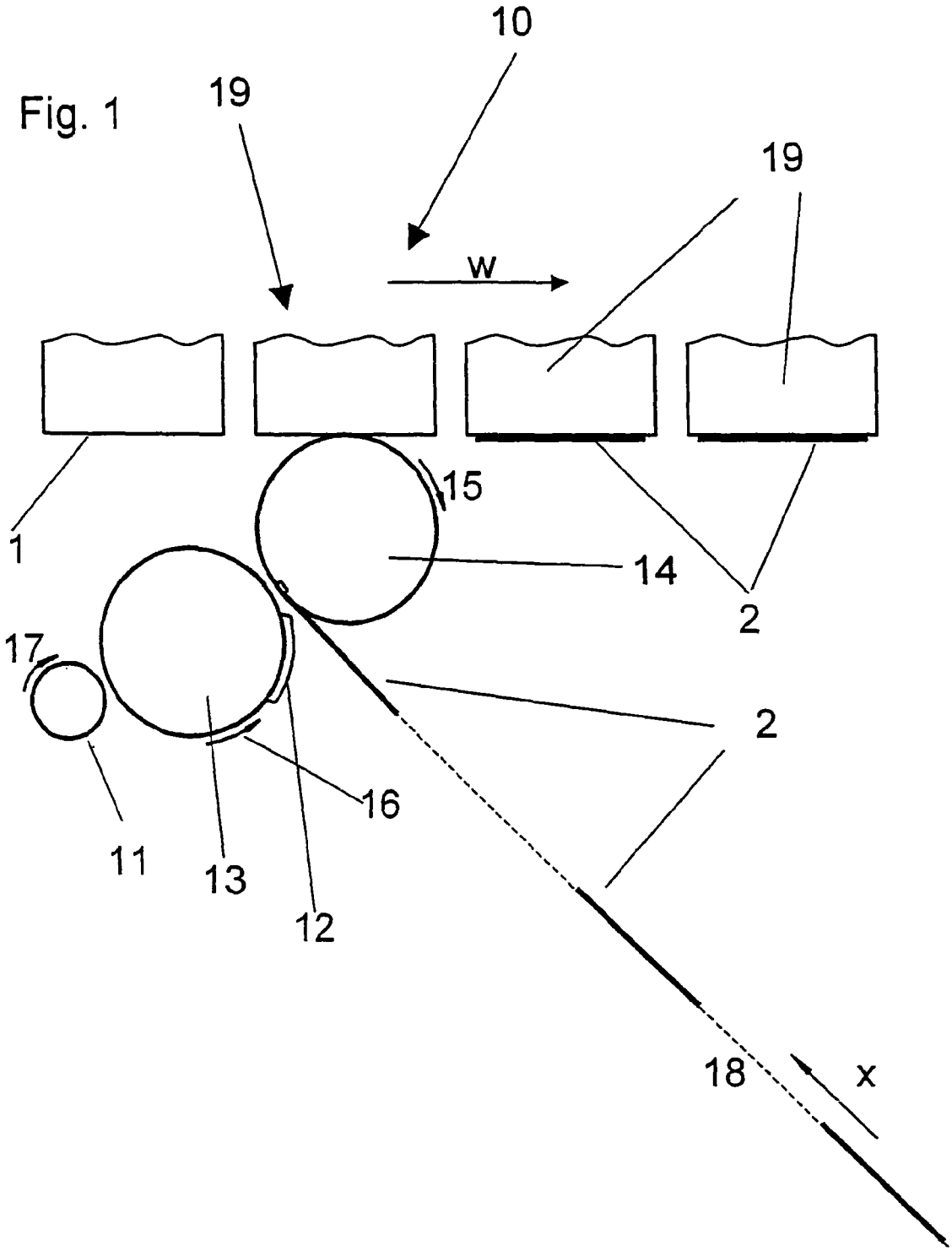
FIG. 1A glue application device for bag bottom sheets in accordance with the prior art.

FIG. 1 illustrates a glue application device as is usually used in accordance with prior art for gluing bottom sheets 2. In this device glue is transferred from a glue cylinder 11 on the format part or plate 12. The format part or plate 12 is carried by a plate cylinder 13 and around the axis of the plate cylinder 13 in the direction marked by the arrow 16. In this movement of rotation the format part or plate 12 transfers glue on the bottom sheets 2 that are carried by the gripper cylinder 14 during the glue transfer. The bottom sheets 2 are carried beforehand by a transport device (not illustrated in the figure) along the dotted line 18 in the direction of the arrow x into the split between cylinders 13 and 14. The rotation of the gripper cylinder 14 in the direction marked by the arrow 15 carries the glued sheets further to the bag bottoms 1. The bag bottoms 1 are transported by a transport device (also not illustrated in the figure) in the direction of the arrow w. The bags 19 are closed by the bag bottoms 1.

Between the gripper cylinder 14 and the transport device of the bags, a pressure is built up that compresses sheets 2 and bag bottoms with each other, thus joining them permanently.

Figure 2:
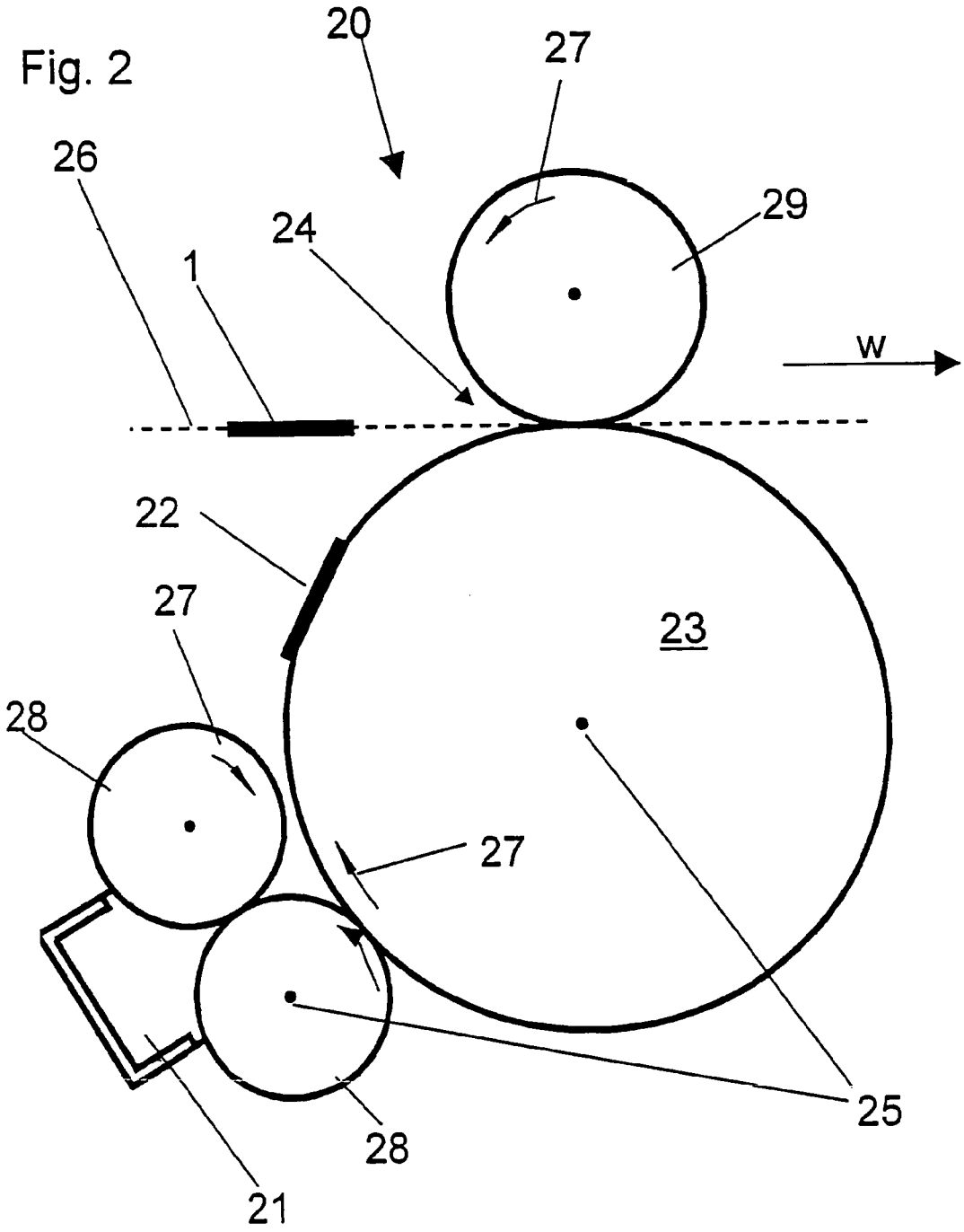
PRIOR ART Fig. 2
FIG. 2 A glue application device for cross bottoms in accordance with the prior art.

FIG. 2 illustrates another glue application device 20 in accordance with prior art that is usually used for gluing the bag bottoms 1. For this purpose, a plate or format part 22 that is attached to the circumference of the plate cylinder 23 is brought into contact with the glue transfer cylinders 28 by the rotation of the plate cylinder 23 around its axis 25 in the direction of the arrow 27 and thus supplied with glue. For this purpose the format part 22, similar to the format part 12, has recesses (not illustrated in the figure). These recesses are filled with glue when they contact the glue transfer rollers.

The glue transfer rollers 28 border the opening of a glue reservoir 21. During their rotation the glue transfer rollers transport glue on their circumference from glue reservoir 21 to the plate 22.

In the further course of the rotation of the cylinder 23, the format part or plate 22 enters into the roller clearance 24 between the cylinders 29 and 23. There the plate 22 transfers glue on a bag bottom 1. The bag is transported beforehand by a conveying device along the dotted line 26 into the roller clearance.

In case the bag formats are altered, the format parts 12, 22 are replaced by format parts that conform to the new bag format.

Figure 3:
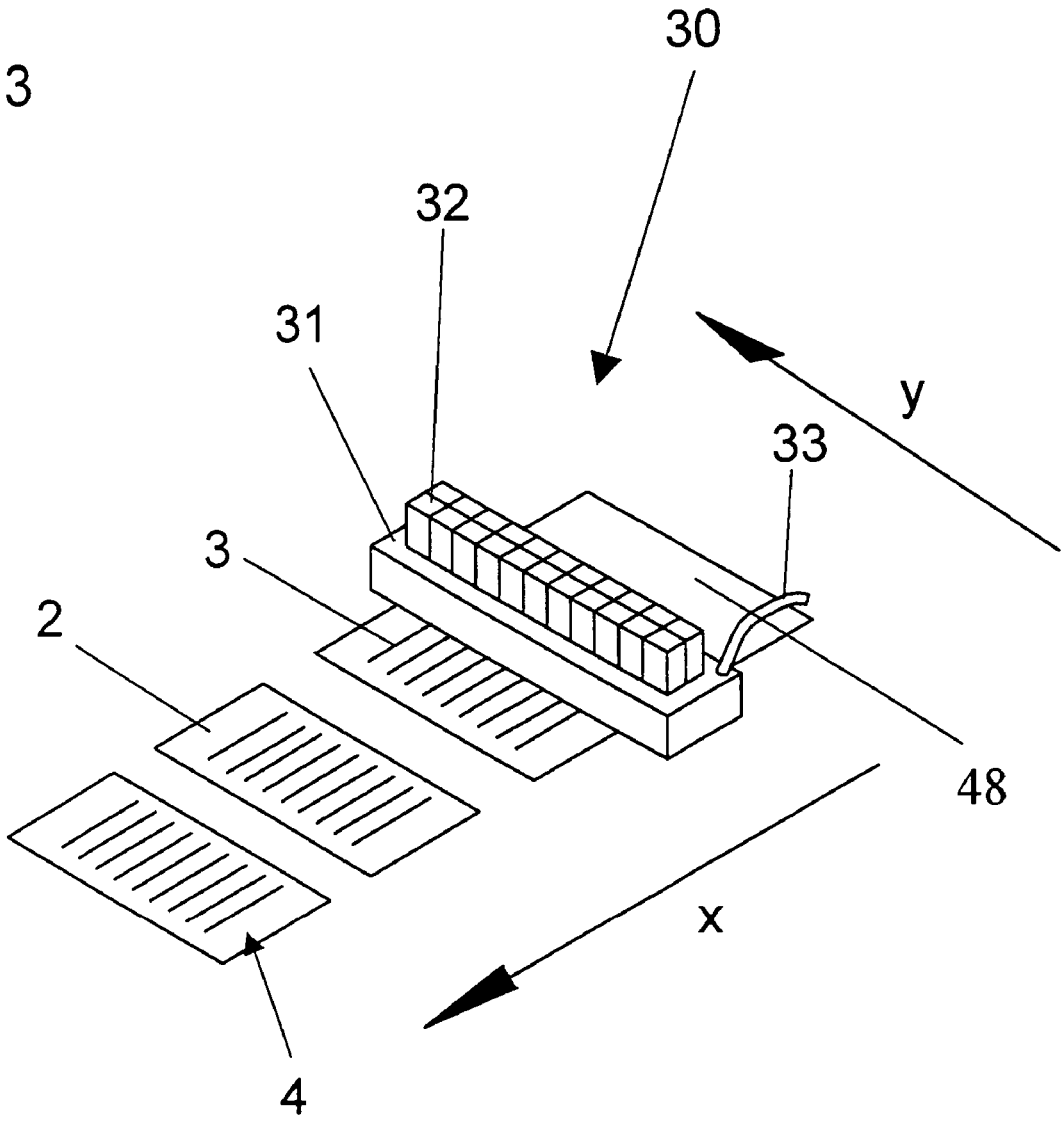
FIG. 3 View of a gluer in accordance with the present invention

FIG. 3 illustrates a sketch of a sheet gluer 30 of a cross bottoming device in accordance with the invention. It provides individual sheets 2 carried in the direction of the arrow x with glue lines 3. For this purpose the gluer 30 is equipped with an application head 31. This application head is provided with glue with the help of the tube 33. The glue is distributed inside the application head 31 by appropriate glue ducts onto the valves 32. The valves 32 are attached to the application head 31 in two rows that run transverse to the conveying direction x of the sheets 2. These valves 32 are at least in the position to release or cut off the glue flow. They can be controlled by external, preferentially electric, signals and they 32 withstand the glue pressure.

On the under surface (not illustrated in FIG. 3) of the application head 31 are the output orifices 71 through which the glue leaves the application head 31 and forms the glue lines 3. The arrow x points to the transfer direction of the sheets 2, while the arrow y points to the horizontal direction running transverse to it.

Figure 4:
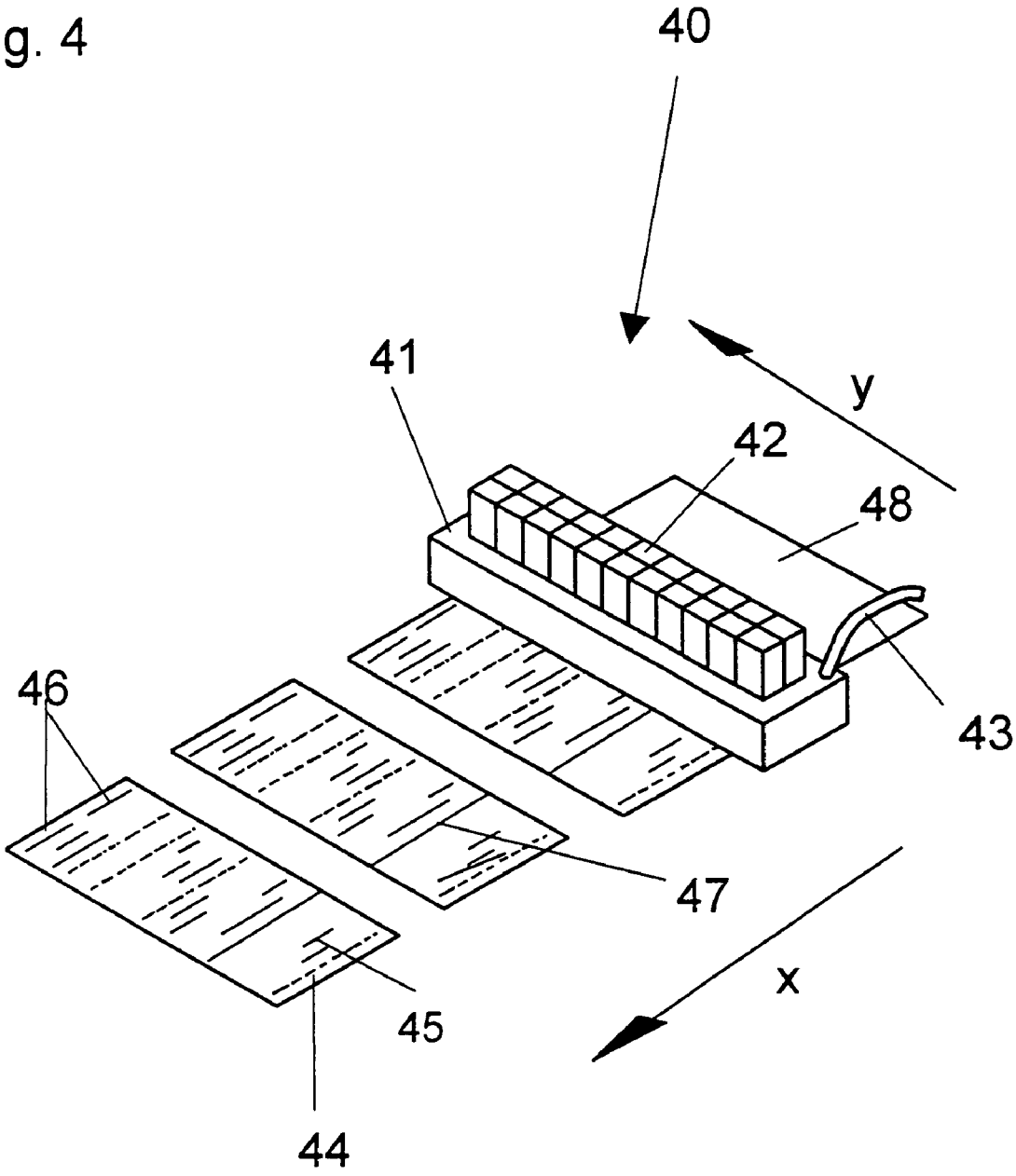
FIG. 4 View of a gluer in accordance with the present invention that produces complex adhesive formats.

FIG. 4 illustrates a gluer 40 that is constructed externally exactly like the gluer 30 from FIG. 3. The various glue lines 44 to 47 show that the most different adhesive formats are realizable using such a device, without having to employ format parts. In this connection a variation of the plate breadth, i.e., the expansion of the adhesive surface in y direction is feasible by a switch-off or switch-on of valves 42 during the production of bags in this adhesive format. The valves that are switched off in this way are not active during the complete duration of the glue application of sheets 2, 48 or bag bottoms of one format. In this manner preferentially rectangular adhesive formats emerge—as illustrated in FIG. 3. These are formed out of the end-to-end glue lines 3, 47 that usually have the same length.

For this purpose the valves that are active white creating an adhesive format must be closed after creating an end-to-end glue track 47. The valves should be reopened when the next still unglued sheet 48 arrives at the output orifices. In case of customary glue application speeds, this work sequence leads to considerable demands on the switching time of the valves 32. If further variations in the form of the adhesive format or adhesive quantity are carried out, the valves 42 must be opened and dosed faster than the creation of end-to-end glue lines 47.

Figure 9A:
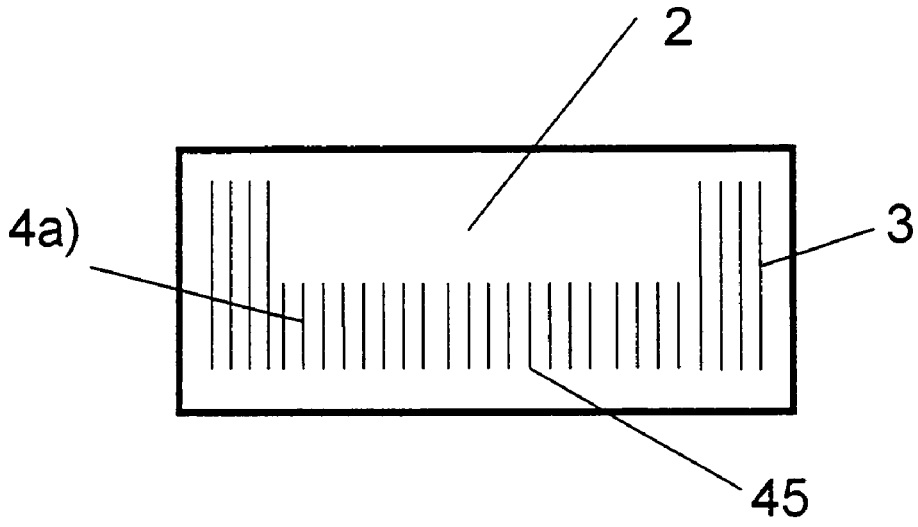
Figure 9B:
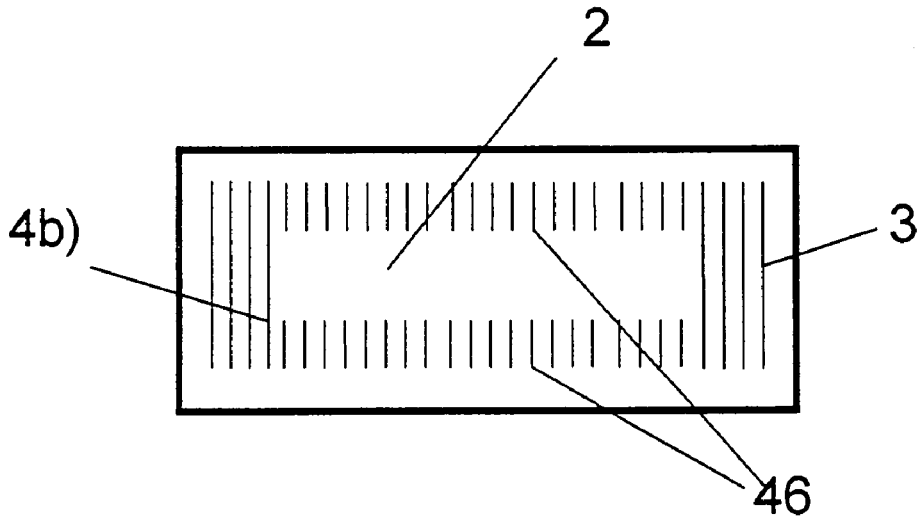

Thus an essential variation of the applied adhesive quantity is possible particularly by applying several noncontinuous glue lines 44. The further variation of the form of the adhesive format, involving a clear deviation from the rectangular shape, requires the application of short 45 and noncontinuous glue lines 46. For example it is often necessary that the adhesive formats 4 have a U-shape 4*a*) or a rectangular frame 4*b*) as is illustrated in FIGS. 9 *a*) and *b*). For this purpose a different control of the valves is necessary while gluing a bag component that is to be glued 1, 2.

It is advantageous if the valves provided in the bottoming device have a switching time and/or are switched in a time period less than 5 milliseconds. Then a large part of the variations of adhesive formats that are required in the industry and can be carried out by changing individual glue line lengths in the x direction, can be implemented in the manner described above using current gluing speeds.

With the help of the various glue lines 45 to 48 it is possible to sense how flexibly such a device in accordance with the present invention can generate formats if the valves are switched even faster.

The design forms illustrated in the FIGS. 3 and 4 are as suitable for the actually illustrated gluing of individual sheets 2 as they are for gluing paper webs that can be separated later. Also in case of the bag bottoms 1 the glue application can be carried out analogously.

Figure 5A:
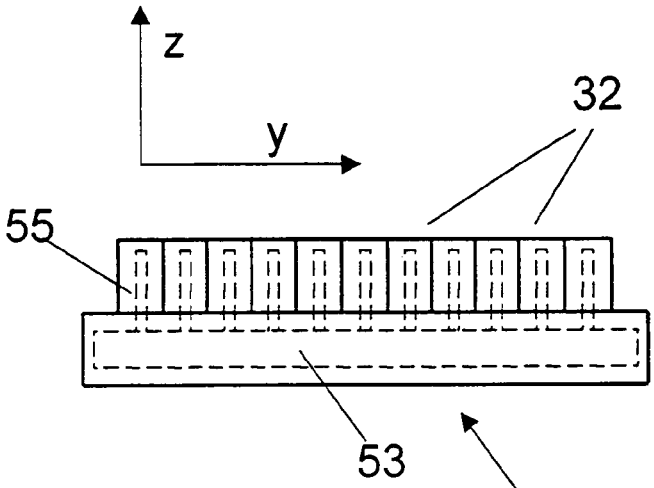
FIG. 5 *a*) A side-view of an example of implementation of the present invention with a glue duct for the glue supply of the valve FIG. 5 *b*) A top-view of the example of implementation of the present invention illustrated in FIG. 5*a*)
Figure 5B:
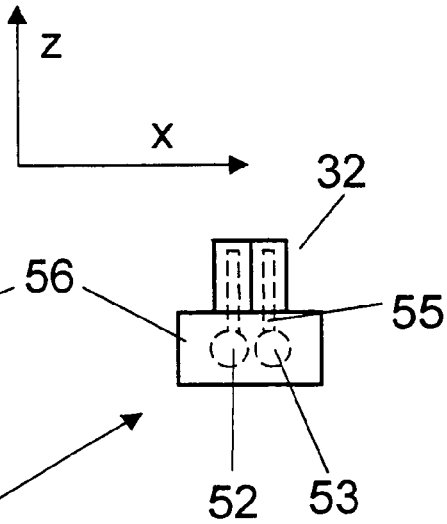
Figure 5C:
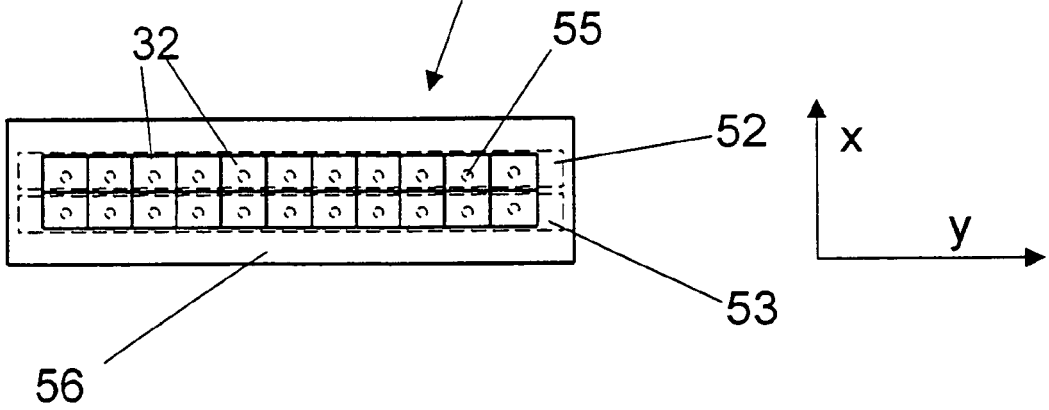

The FIGS. 5 *a*), *b*) and *c*) illustrate a preferential design form of the glue duct inside a design form of an application head 50 to the valves 32. Also, the glue output borehole 71 and the glue duct from the valves 32 to the glue output lines 71 are not illustrated here considering the clarity of FIGS. 5 *a*) to *c*).

The glue duct results from two transverse channels 52 and 53 that are illustrated with dotted lines in the FIGS. 5*a*) and 5*b*). These channels run in the application head 50 essentially transverse to the conveying direction x of the sheets 2 or bag bottoms 1. FIG. 5 *c*) illustrates that these two glue channels 52, 53 in the illustrated design form are boreholes for production reasons. However, the channels can have another shape just as well.

Glue channels 55 rise from the glue channels 52, 53 in vertical direction z to each valve. The glue arrives through these glue channels 55 directly to the valve 32.

Both the glue channels 52 and 53 can be advantageously connected to the front end of the head opposite to the glue ducts. The connection takes place by means of another glue channel that runs in the application head 50 in x direction. In this way the glue can flow e.g., via the glue channel 52 provided for this purpose with a feed line, and flow through the connection channel and through the glue channel 53 in order to drain finally through a glue discharge. In this manner a glue circulation through such an application head is possible.

These additional characteristics are however not illustrated in the FIGS. 5 *a*) to *c*).

Figure 6:
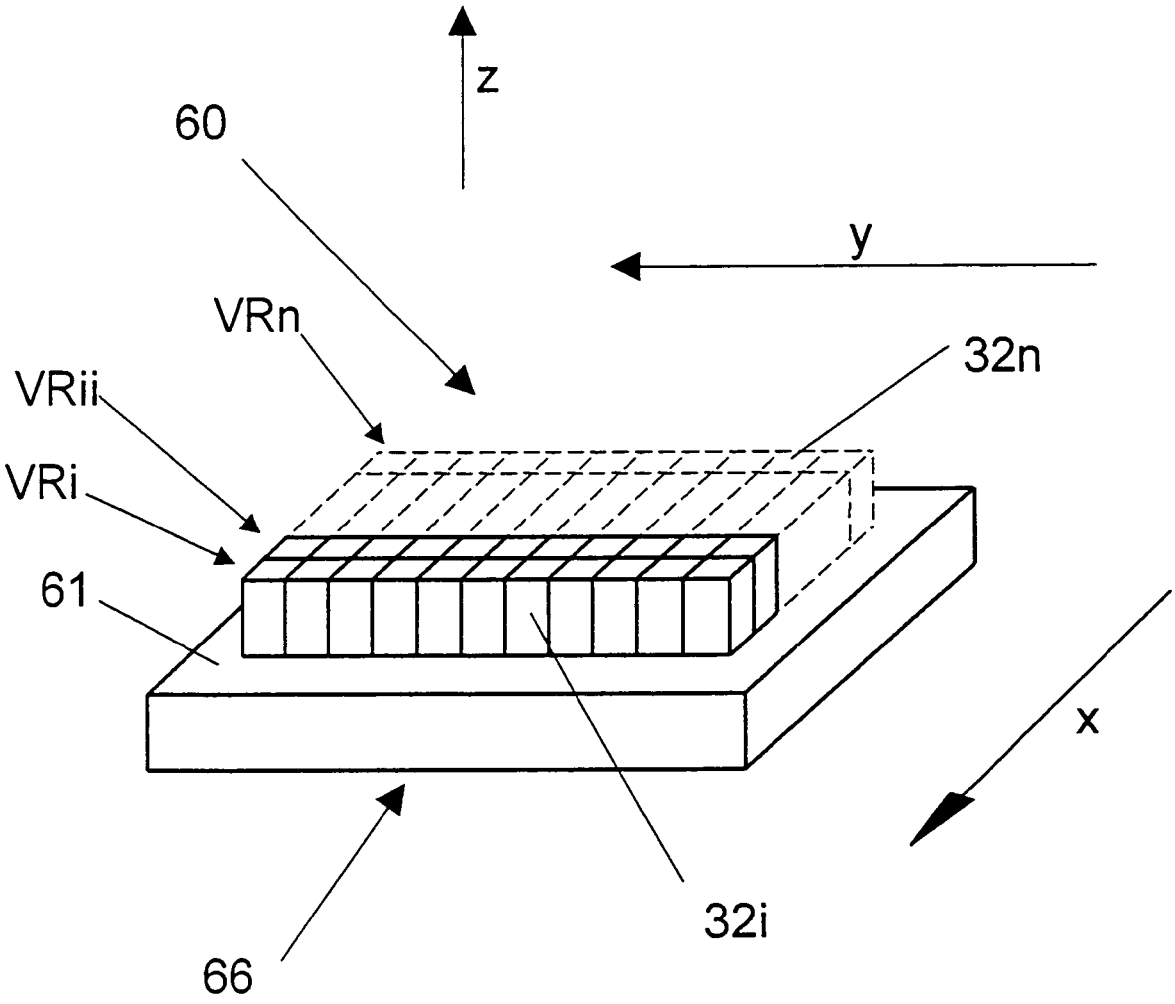
FIG. 6 A view of an application head with several rows of valves
Figure 7A:
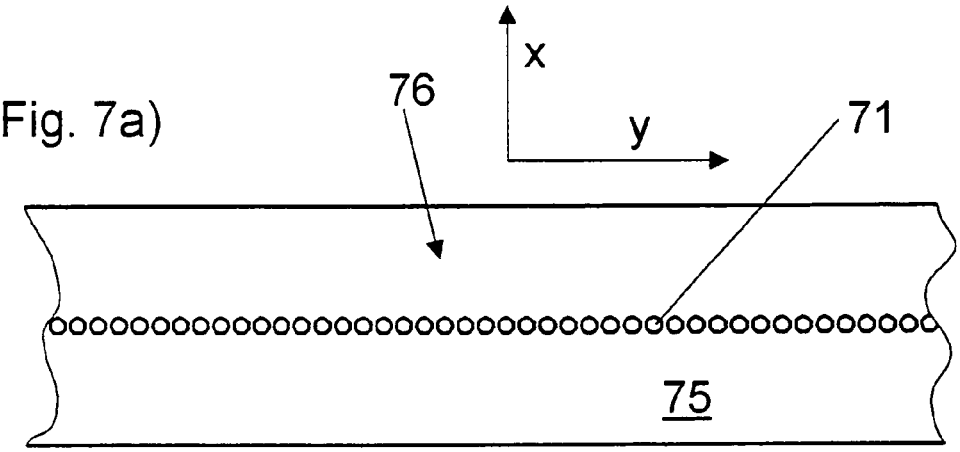
FIG. 7 *a*) A view of the side of an application head. The side illustrated is facing the parts to be glued.
Figure 7B:
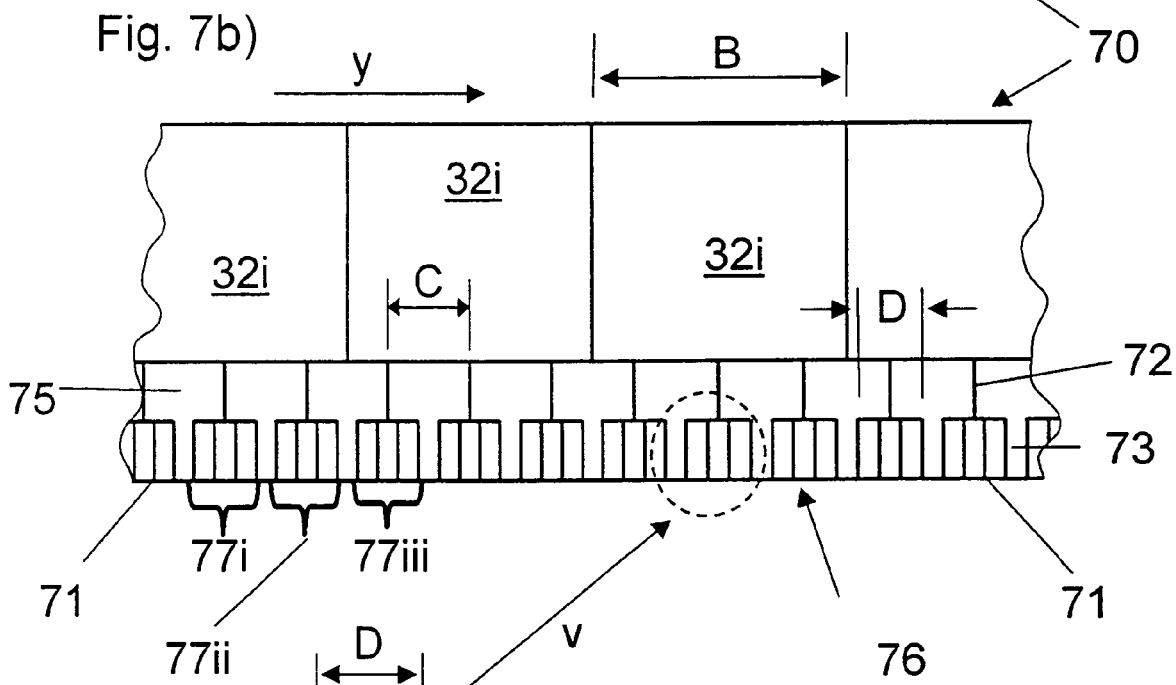
Figure 7C:
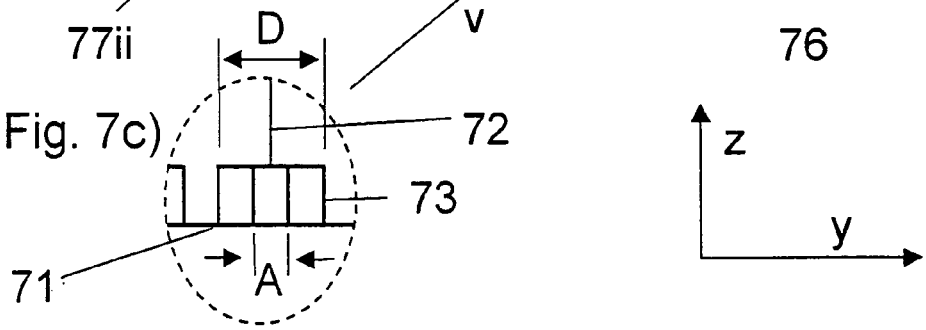

The FIGS. 6 and 7 highlight once again the relation between the number of valves 32 and the glue output orifices 71.

This relation influences decisively the possibilities of adjusting the adhesive format breadth. Adhesive format breadth implies again the expansion of the adhesive format 4 in y direction. If only a limited number of valves is provided to which a large number of glue output orifices is assigned in each case, the desired format breadth is achieved roughly, i.e., with very low resolution. However tests show that at least one satisfactory portion of customary formats can be produced advantageously with a quorum of five valves that can be controlled independent of each other.

In the application head 60 illustrated in FIG. 6 several rows of valves VRi to n are arranged one after another successively in the transfer direction x of the bag components that are to be glued. In order to illustrate the allocation of the valves to the valve rows, the reference numbers of the valves 32 and the glue channels assigned to them 72, 73 are indexed with the numbers of the respective valve row i-n.

It is advantageous to arrange the valves 32 in y direction one after another because the valves 32 that come into question for such a glue application device have a considerable overall breadth B. This overall breadth B often exceeds the desired distance between the glue lines in the direction transverse to the transport of the bag components. Generally it is advantageous to assign several glue output orifices to each valve as illustrated in FIG. 7 *b*). However in such a design form of the present invention, the closure of a valve leads to the interruption of several glue lines so that finally a lower resolution must be considered in case of the free structuring of the breadth of the adhesive format 4. In case of an arrangement of a very large number of valves 32 on one application head 61, it is possible to arrange the glue lines in the y direction close to one another and at the same time to achieve a very high resolution in the formation of the adhesive profile. It is also possible for this purpose to offset the valve rows in y direction against each other. Also in case of an application head with several valve rows VRi to VRn it is possible to ensure that the glue output orifices lie in one line as illustrated in FIG. 7 *a*). This can be achieved by directing the vertical glue output channels 72, 73 in x direction.

The afore-mentioned FIG. 7 *a*) illustrates the side 76 of an application head 70 that is facing the bag components 1,2. The application head 70 consists essentially of a valve mounting plate 75 on which the valves 32 are located. As mentioned already the glue output orifices lie in one line that runs orthogonally here to the conveying direction x of the sheet 2. Thus in the illustrated design form of the invention the boreholes 71 in x direction lie at the same level.

To position the output orifices 71 in x direction differently, differences in the run-time must be taken into account while controlling the valves. These differences in the run-time occur because the same bag component 1, 2 passes the glue outlets that are unequally arranged in x direction at different points of time. These run-time differences are speed-dependent and thus difficult to be taken into account. Therefore the arrangement illustrated in FIG. 7 *a*) is markedly advantageous.

FIG. 7 *b*) illustrates how glue arrives from the valves 32 to the glue output orifices 71. In the view illustrated in FIG. 7 *b*) only the valves 32*i* in the first valve row VRi can be seen. In the design form illustrated in FIG. 7 *b*), however, three valve rows are provided of which the two back rows are not illustrated. However, in this design form four glue output orifices 71 are assigned to each valve 32*i* to 32*iii*. The braces 77*i* to 77*iii* mark three adjoining groups of glue output orifices 71 whereby each group is assigned at a time to a valve out of each of the three valve rows VRi to VRiii. In the y direction the openings of the valves lie centrally, thus in the center of their valve breadth B. These valve openings are aligned with the upper glue outlet channel 72. In order to enable this type of arrangement the valve rows VRi to VRiii are each offset against each other by the distance C in the y direction. In the illustrated arrangement the distance A between the glue output orifices 71 is much smaller than the valve breadth B. Thus, initially very fine glue lines 3 with small interspacing can be created that can be turned into a flat application easily through smearing or compressing.

In the present design form of the invention the distance C defines the resolution already discussed above between adjoining two upper glue outlet channels 72 in y direction when the format breadth is adjusted by switching the valves on or off selectively. Similarly the distance C also defines the resolution when the shape of the adhesive format is adjusted, that is the desired deviation from the rectangular shape of the format 4 illustrated in FIG. 3 that has already been discussed with reference to FIGS. 4 and 9 *a*) *b*).

In this context FIG. 7*b*) also illustrates the importance of the measure D that results from the addition of the distances A between the glue output orifices 71, that are fed with glue from a valve.

In the example of implementation illustrated in the FIG. 7 *b*), owing to the described arrangement of different valve rows VRn behind one another, it is possible, that the dimension D is also clearly smaller than the valve breadth B (here $D<B/3$). This factor is markedly advantageous because the consequently larger resolution in the case of a variation in format breadth and shape allows a more exact reduction of these measurements to what is actually necessary. Thus glue is saved. This is possible in case of sufficient resolution also without changing format parts 12, 22.

Figure 8A:
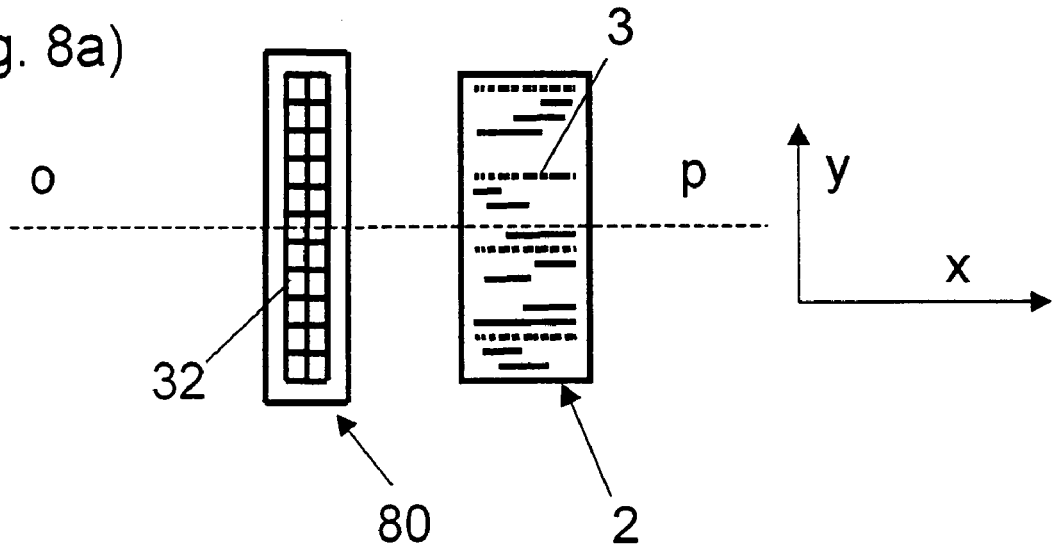
FIG. 8 *a*) A top-view of an application head that can move in the y-direction FIG. 8 *b*) A top-view of an application head that can move in the y-direction FIG. 8 *c*) A top-view of an application head that can move in the y-direction FIG. 9 *a*) A sheet 2 with a U-shaped adhesive format FIG. 9 *b*) A sheet 2 with an adhesive format in the shape of a rectangular frame.
Figure 8B:
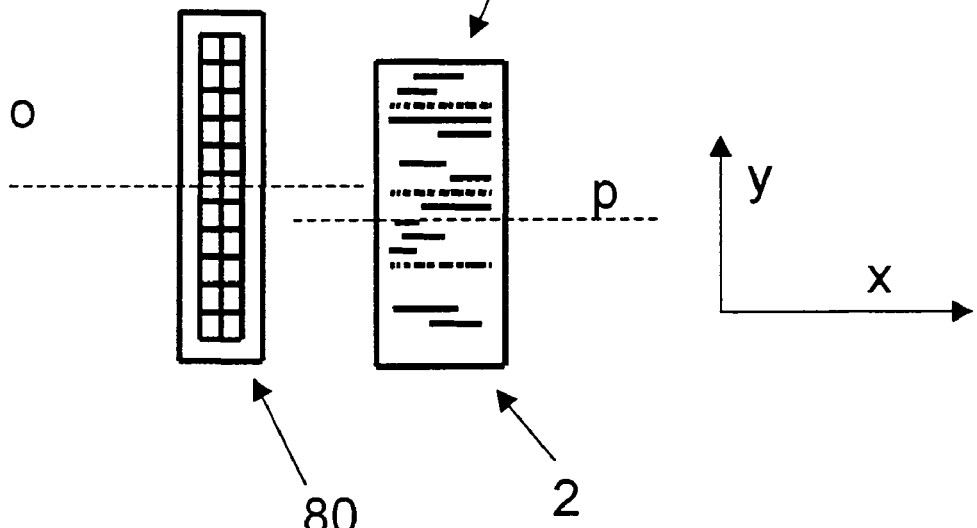
Figure 8C:
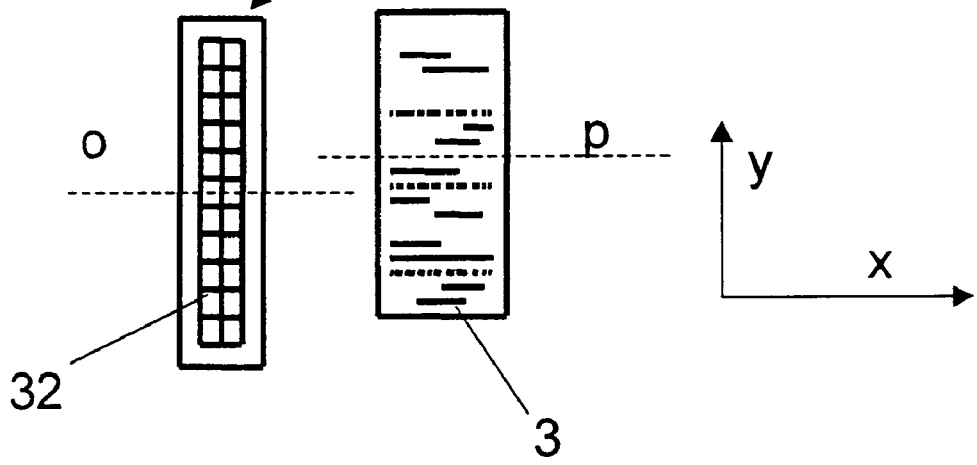

FIGS. 8 *a*) to 8 *c*) illustrate in top-views of an example of implementation the mobility of an application head 80 in y direction relative to the sheets 2. This design form of the invention opens up further variation possibilities in the areas of resolution and format breadth and thus further increases the flexibility when the adhesive profile 4 is formed freely, without making an exchange of format parts necessary.

The mobility is clearly on the basis of the position of the center lines o and p drawn in the illustration. The center lines o and p run through the center of the application head 80 and the sheet 2. In FIG. 8 *a*) both these lines are in alignment. In both of the other figures a relative displacement of the application head 80 has taken place opposite to the sheet 2. An extensive illustration of a displacement mechanism is omitted here.

As already mentioned the FIGS. 9 *a*) and *b*) illustrate a U-shaped 4*a*) and a rectangular glue format 4*b*) on two sheets 2. The U-shaped glue format consists of end-to-end 3 and short glue lines 45. The glue format in the shape of a rectangular frame 4 *b*) is made up of end-to-end 3 and noncontinuous glue lines 46. The different flow pattern of the glue lines is possible by controlling the glue valves 32 selectively during the gluing of a bag component 1, 2 that is to be glued.

In the figures no pumps or pressure tanks are illustrated that are usually required in order to convey the glue and build up or maintain the glue pressure required for the extrusion. All examples of implementation of the present invention illustrated and also described by the claims below also apply to an indirect gluing of bag components 1, 2 whereby the glue is first transferred on a roller or another form before it arrives on the bag components.

Figure 10:
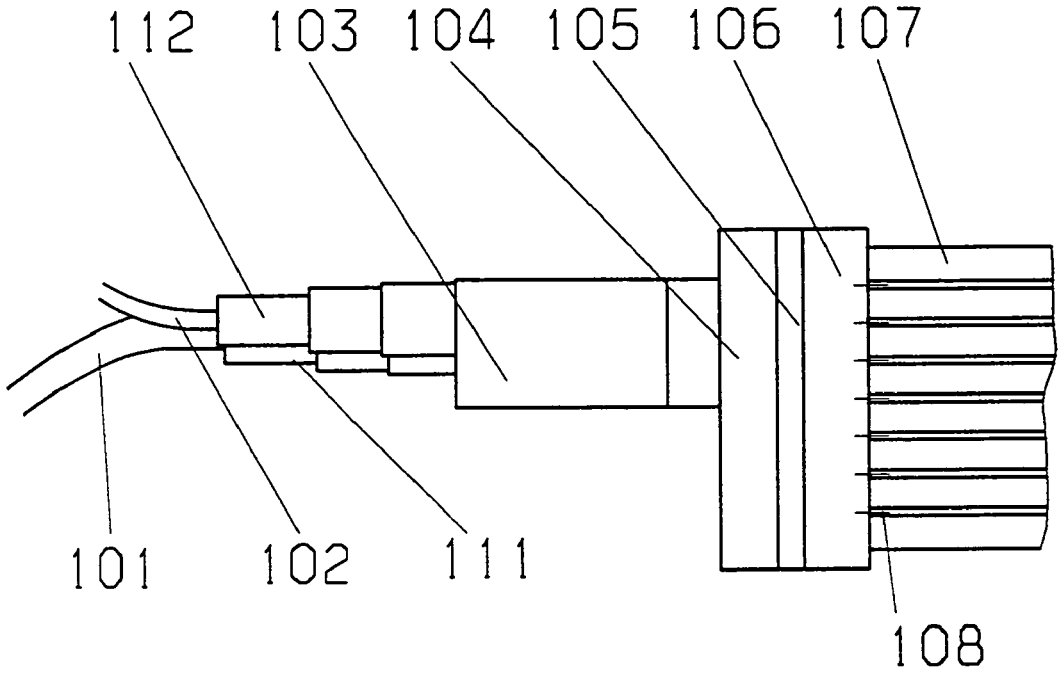
FIG. 10 Another side-view of a nozzle applicator

FIG. 10 illustrates another side-view of a nozzle applicator 114 as used e.g., in a bag machine. The nozzle 103 of the nozzle applicator is provided with a liquid glue via the glue supply 101 that meets the glue inflow 111. The nozzle applicator receives power and control signals via the control line 102 and the connector 112.

Figure 11:
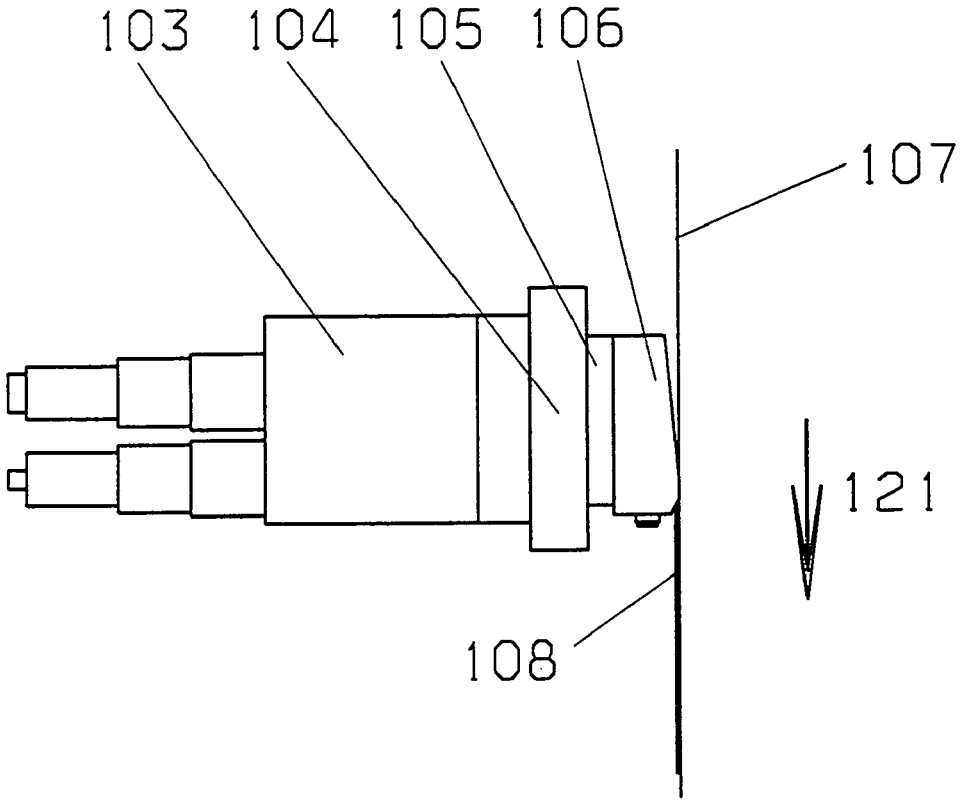
FIG. 11 Another top-view of a nozzle applicator

FIG. 11 illustrates another top-view of the same device.

Figure 12:
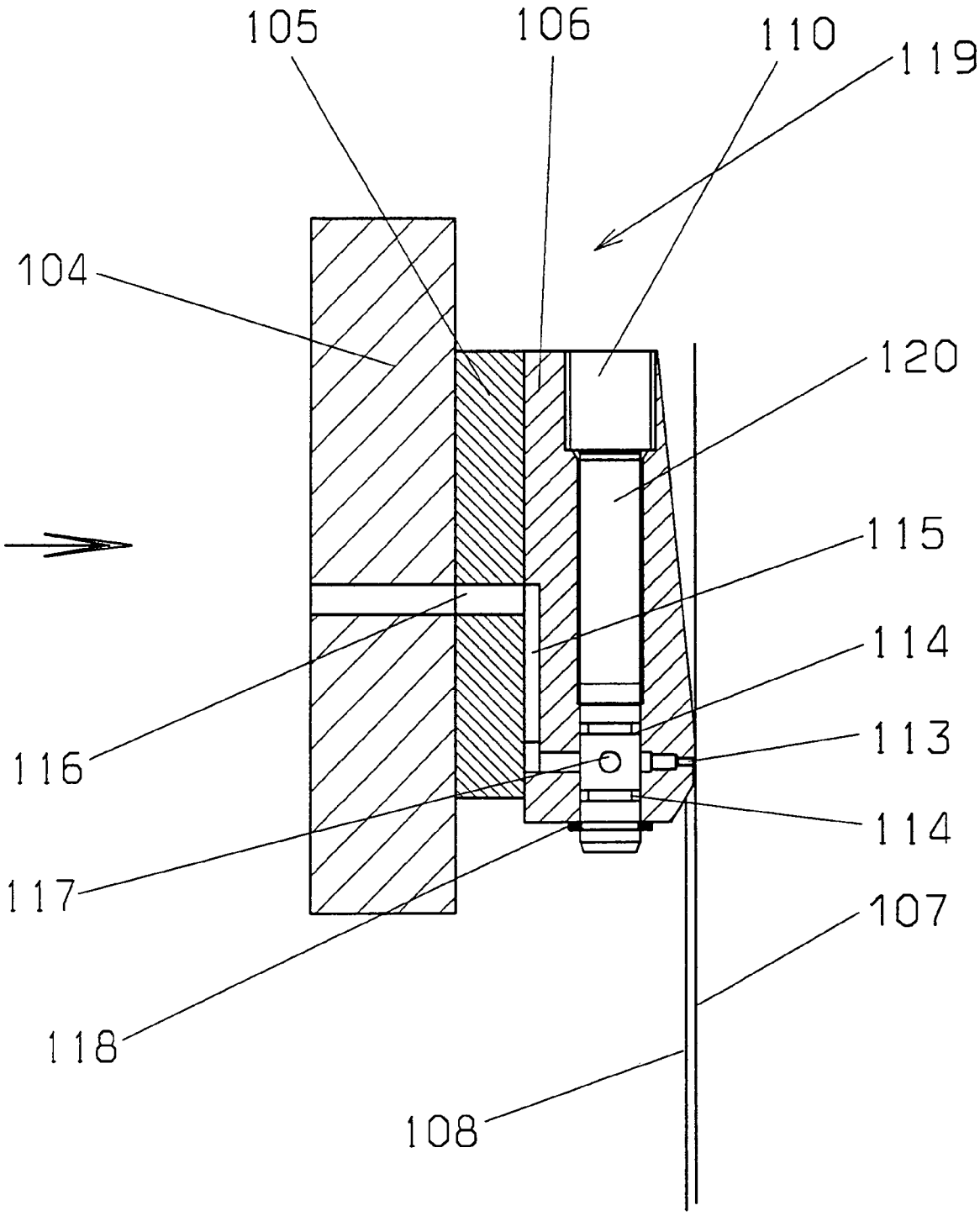
FIG. 12 Another section through a format plate system in accordance with the present invention (section A-A in FIG. 4)
Figure 13:
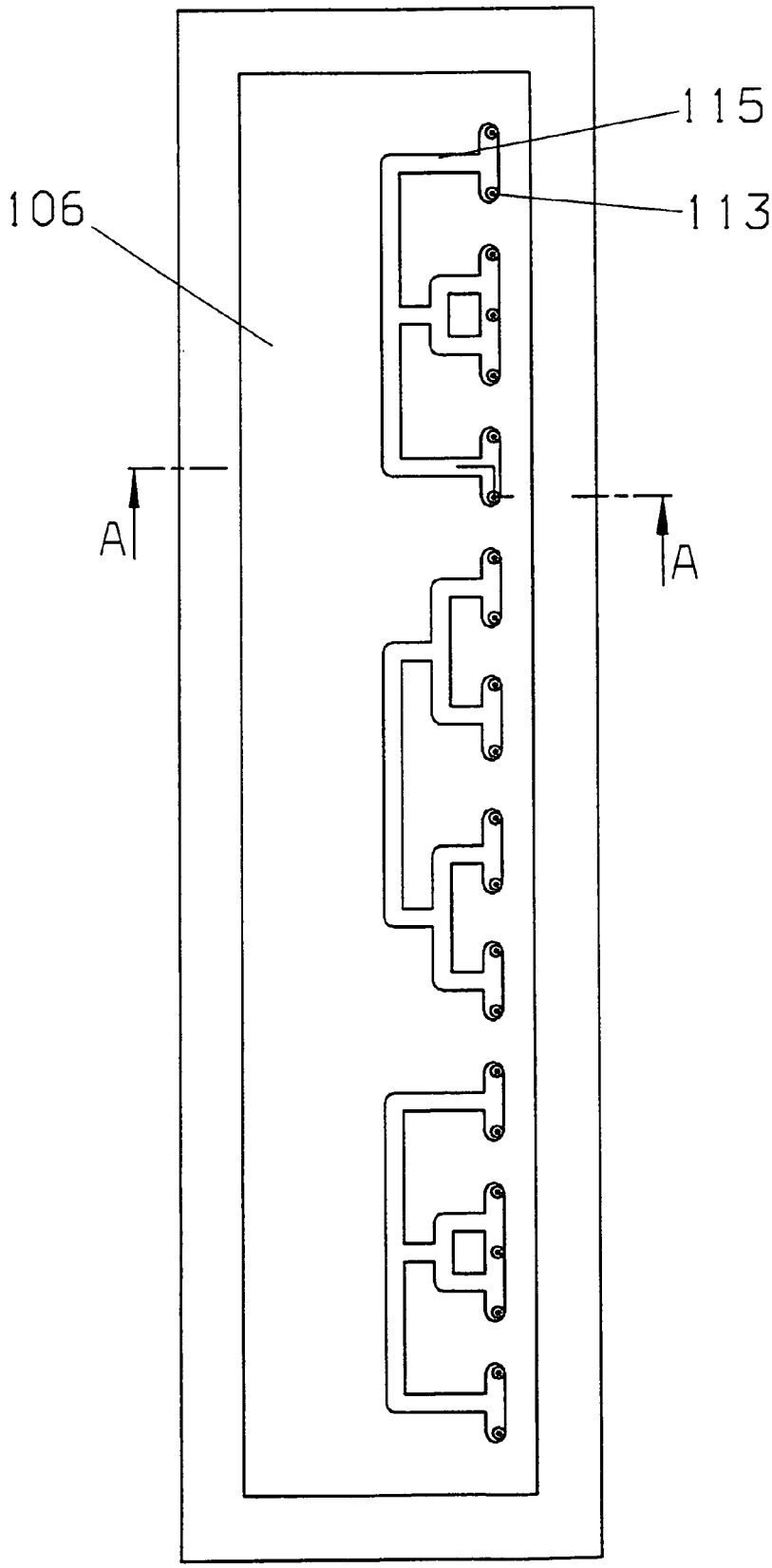
FIG. 13 Another top-view of a pin plate that is mounted on a base plate.

FIG. 12 illustrates another section A-A through the format plate system 119. The format plate system 119 consists in this example of implementation of the base plate 104, the sandwich plate 105 and the pin plate 106. By opening the valve 103 the pressurized glue is compressed by the inlet 116. The complete channel system 115 defined by the pin plate is illustrated in FIG. 13. A channel system can also be a system with several channels 115. The main purpose of such a channel system is the distribution of the glue onto several output orifices. That is all the more important since the gap between the output orifices is usually smaller than the breadth of the valves. Also the costs of the valves are high and justify the use of such a channel system. Therefore it is also possible to provide several channels with glue from one valve. The channels can then distribute the glue on several output orifices. In the example of implementation illustrated, the adhesive and/or glue arrives from the channels 115 into the output orifices 113. Subsequently the adhesive leaves the output orifices 113 and is applied on paper or foil material 107 and forms adhesive tracks 108 there since the material 107 is moved past the format plate system 119 in the direction of the arrow 121. In the illustrated example of implementation the output orifices 113 are sealable by pins 120. These pins are fastened rotatably in the pin plate 106 and are fixed by the safety device 118 in axial direction. The pins 120 pierce through the output orifices 113. On the level of the output orifice 113 the pins contain a glue outlet orifice 117. In an appropriate adjustment this borehole allows glue to pass through so that adhesive is applied on the material 107. In FIG. 12 the adhesive application has just been completed. For this purpose the pin 120 was turned by 90° just like a screw with the help of a groove (not illustrated in the figure) in the pinhead 110, so that the axis of the glue admission orifice 117 projects out of the drawing plane and one can look into this opening 117.

FIG. 13 illustrates a top-view of a pin plate 104 that is removed from the remaining format plate system 119. The observer looks in the direction of the glue flow on this plate. The channels 115 and the output orifices can be recognized clearly.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of reference symbols

| | |
|---|---|
| x | Conveying direction of the sheets |
| y | Direction in space transverse to the conveying direction of the sheets (horizontal) |
| z | Direction in space transverse to the conveying direction of the sheets (vertical) |
| w | Conveying direction of the bag bottoms 1 |
| 1 | Bag bottom |
| 2 | Sheet |
| 3 | Glue line |
| 4 | Rectangular adhesive format |
| 4 a) | U-shaped adhesive format |
| 4 b) | Adhesive format in the shape of a rectangular frame |
| 10 | Known gluer, preferentially for sheets |
| 11 | Glue cylinder |
| 12 | Plate and/or format part |
| 13 | Plate cylinder |
| 14 | Gripper cylinder |
| 15 | Arrow in the rotating direction of the gripper cylinder 14 |
| 16 | Arrow in the rotating direction of the plate cylinder 13 |
| 17 | Arrow in the rotating direction of the glue cylinder 17 |
| 18 | Dotted line |
| 19 | Bag |
| 20 | Known gluer, preferentially for cross bottoms |
| 21 | Glue reservoir |
| 22 | Plate and/or format part |
| 23 | Plate cylinder |
| 24 | Roller clearance |
| 25 | Axes of the cylinders |
| 26 | Dotted line that sketches the route of transport of the bags |
| 27 | Rotating direction of the cylinders |
| 28 | Glue transfer cylinder |
| 29 | Impression cylinder |
| 30 | Glue application in accordance with the invention |
| 31 | Application head and/or application plate |
| 32 | Valves |
| 32n | Valve of the nth. valve row |
| 33 | Glue feed line/tube |
| 40 | Gluer in accordance with the invention |
| 41 | Application head and/or application plate |
| 42 | Valves |
| 43 | Glue feed line/tube |
| 44 | Glue lines discontinued at regular distances |
| 45 | Short glue line |
| 46 | Noncontinuous glue line |
| 47 | End-to-end glue line |
| 48 | Non-glued sheet |
| 50 | Application head |
| 52 | Glue channel in y direction (horizontal) on the application head |
| 53 | Glue channel in y direction (horizontal) on the application head |
| 55 | Glue channel in z direction (vertical) on the application head |
| 56 | Mounting plate |
| 60 | Application head with n valve rows |
| 61 | Valve mounting plate |
| VRi | First valve row |
| VRii | Second valve row |
| VRn | nth valve row |
| 66 | The side of the valve mounting plate facing away from the bag components to be glued. |
| 70 | Application head |
| 71 | Glue output orifice |
| 72 | Upper glue output channel |
| 73 | Lower glue output channel |
| 75 | Valve mounting plate |
| 76 | The side of the valve mounting plate facing the bag components to be glued |
| 77i | First group of glue output orifices |
| 77ii | Second row of glue output orifices |
| 77iii | Third row of glue output orifices |
| A | Distance between two glue output orifices 71 in y direction |
| B | Breadth of the valve 32 in y direction |
| C | Distance between two adjoining upper glue output orifices in y direction |

-continued

| List of reference symbols | |
|---|---|
| D | Sum of the distances between the glue output orifices 71 that are provided with glue from a valve. |
| 80 | Example of implementation of an application head |
| o | Center line of the application head 80 |
| p | Center line of the sheet 2 |
| y | Space direction transverse to the conveying direction of the bag components |
| 101 | Glue supply |
| 102 | (electric) control line |
| 103 | Electromagnetic valve |
| 104 | Base plate |
| 105 | Sandwich plate |
| 106 | Pin plate |
| 107 | Paper/foil |
| 108 | Adhesive/glue (starch basis or dispersion) |
| 109 | |
| 110 | Pinhead |
| 111 | Glue inflow |
| 112 | Connector |
| 113 | Output orifice |
| 114 | Sealing |
| 115 | Channel |
| 116 | Inflow |
| 117 | Glue supply borehole |
| 118 | Pin safety device (retainer) |
| 119 | Format plate system |
| 120 | Pin |
| 121 | Arrow in the direction of the material (107) handling |

What is claimed is:

1. A bottoming device for forming a cross bottom paper bag, the device configured to form the cross bottom of the paper bag by providing folds at extremities of a tubular segment from which the bag is produced such that lines of a glue are applied to at least one of a folded bottom on the extremities of the tubular segment and a sheet to be glued with the bottom, and to connect and glue the folded bottom and the sheet, the bottoming device comprising a gluer having an application head with a glue duct in which the glue is exposed to a pressure that is higher than ambient pressure such that the glue is transported throughout the application head, the application head including a plurality of valves each having at least one glue output orifice through which the glue is directly applied to the at least one of the folded bottom and the sheet, the valves being arranged in a configuration that includes at least a first valve row (VRi) and a second valve row (VRii) with each of the first and second valve rows extending along a length of the application head in a direction (y) that is transverse to a bag transfer direction (x), and a glue circulation channel that provides for circulation of the glue within the application head, the glue circulation channel including (i) a first transverse channel and a second transverse channel each extending along the length of the application head in the (y) direction, and (ii) a connection channel extending across the application head in the (x) direction, the connection channel connecting an end of the first transverse channel to an adjacent end of the second transverse channel, the glue circulation channel providing for glue flow through the first transverse channel, across the connection channel, and through the second transverse channel to drain from the application head.

2. The bottoming device in accordance with claim 1 wherein the glue application is performed between the glue output orifice and the at least one of the sheet and the folded bottom in a contact-free manner.

3. The bottoming device in accordance with claim 1 wherein the valve configuration includes a plurality of valve rows (VRi, VRn).

4. The bottoming device in accordance with claim 3 wherein each of the plurality of valve rows includes a plurality of valves.

5. The bottoming device in accordance with claim 4 wherein each of the valve rows is offset laterally in the (y) direction from an adjacent valve row.

6. The bottoming device in accordance with claim 1 wherein each of the first and second valve rows includes a plurality of valves.

7. The bottoming device in accordance with claim 1 wherein each of the valves includes a plurality of glue output orifices.

8. The bottoming device in accordance with claim 7 wherein the application head has a plate-like form whereby the glue output orifices are provided on a side of the application head facing the bag that is being formed.

9. The bottoming device in accordance with claim 7 wherein a distance (A) between adjacent orifices along the (y) direction is less than a breadth (B) of each of the valves.

10. The bottoming device in accordance with claim 9 wherein a sum (D) of the distances (A) between the glue output orifices in each of the valves is less than the breadth (B) of the valve.

11. The bottoming device in accordance with claim 7 wherein the glue output orifices are located in one line extending along the length of the application head in the (y) direction.

12. The bottoming device in accordance with claim 7 wherein the valves are supplied with the glue by at least one borehole or chamber in the application head.

13. The bottoming device in accordance with claim 12 wherein the borehole or chamber extends substantially transverse to the bag transfer direction (x).

14. The bottoming device in accordance with claim 7 wherein a distance between the output orifices can be selected during the application of the glue.

15. The bottoming device in accordance with claim 1 wherein the valves are provided on a side of the application head facing away from the bag that is being formed.

16. The bottoming device in accordance with claim 1 wherein the application head is moveable in the (y) direction transverse to the bag transfer direction (x).

17. The bottoming device in accordance with claim 1 wherein the application head is rotatable from a glue application position.

18. The bottoming device in accordance with claim 17 wherein the rotatable application head is positionable in various stationary positions each dedicated to a specific function.

19. The bottoming device in accordance with claim 18 wherein at least two of the stationary positions are dedicated to at least two functions including applying the glue to form the bag, sealing the glue output orifices, removing any glue contaminating the application head, and rinsing the application head.

20. The bottoming device in accordance with claim 1 wherein the glue duct has a water connection.

21. The bottoming device in accordance with claim 20 wherein the water connection has a check valve.

22. The bottoming device in accordance with claim 1 wherein the glue duct includes at least one of a pressure relief valve, a pressure sensor, and a pressure controller.

23. The bottoming device in accordance with claim 1 wherein the application head includes a projection on a side facing the bag that is being formed, and the projection is closer to the bag than is the output orifice during the glue application.

24. The bottoming device in accordance with claim 1 wherein the application head includes flexible lines that provide at least one of the glue and water to the head.

25. The bottoming device in accordance with claim 1 wherein each of the valves is controllable independently of the other valves such that the glue application from the respective glue output orifice can be selectively started and stopped.

26. The bottoming device in accordance with claim 25 wherein the valve is controllable to open and close during the glue application.

27. The bottoming device in accordance with claim 1 wherein the application head includes at least five valves.

28. The bottoming device in accordance with claim 1 wherein the glue duct has a cross-sectional area that is at least half as large as a sum of cross-sectional areas of the glue output orifices.

29. The bottoming device in accordance with claim 1 further comprising a metallic cylinder hard counter bearing on which at least one of the folded bottom and the sheet are located during the glue application.

30. The bottoming device in accordance with claim 1 wherein the application head includes at least one stopper located in a transport path of the glue to the valves with which at least one of the glue duct and the glue output orifices can be sealed.

31. The bottoming device in accordance with claim 30 wherein the stopper includes a pin.

32. The bottoming device in accordance with claim 31 wherein the pin is rotatably held in a format plate having a glue outlet such that rotation of the pin seals at least one of the duct and the glue output orifices.

33. The bottoming device in accordance with claim 31 wherein the pin is inserted in at least a part of the glue output orifice such that a main axis of inertia of the pin coincides with an axis of the glue output orifice.

34. The bottoming device in accordance with claim 1 wherein for a specific gluing format at least one of the valves is opened or closed at certain points of time relative to the other valves during the glue application.

35. The bottoming device in accordance with claim 34 wherein a time period between the opening and the closing of the valve is less than 5 milliseconds.

36. A bottoming device that forms a cross bottom paper bag, the device configured to form the cross bottom of the bag by providing folds at extremities of a tubular segment from which the bag is produced such that lines of a glue are applied to at least one of a folded bottom on the extremities of the tubular segment and a sheet to be glued with the bottom, and to connect and glue the folded bottom and the sheet, the bottoming device comprising a gluer having an application head including a plurality of valves each having at least one glue output orifice through which the glue is directly applied under pressure to the at least one of the folded bottom and the sheet, the valves being arranged in a configuration that includes a plurality of valve rows (VRi to VRn) each extending along a length of the application head in a direction (y) that is transverse to a bag transfer direction (x), with each of the valve rows including a plurality of valves (Vi to Vn) arranged along a length of the valve row, and a glue circulation channel that provides for continuous circulation of the glue within the application head, the glue circulation channel including (i) a first transverse channel and a second transverse channel each extending along the length of the application head in the (y) direction, and (ii) a connection channel extending across the application head in the (x) direction, the connection channel connecting an end of the first transverse channel to an adjacent end of the second transverse channel, the glue circulation channel providing for glue flow through the first transverse channel, across the connection channel, and through the second transverse channel to drain from the application head.

37. The bottoming device in accordance with claim 36 wherein each of the valves includes a plurality of glue output orifices.

38. The bottoming device in accordance with claim 37 wherein each of the valve rows is offset laterally in the (y) direction from an adjacent valve row.

39. The bottoming device in accordance with claim 38 wherein each of the valves includes a group of glue output orifices oriented in a line extending in the (y) direction and having an orifice group width (D), the orifice group being centered within a breadth (B) of the valve.

40. The bottoming device in accordance with claim 39 wherein the offset (C) is equal to a lateral distance between the centered orifice group in one of the valve rows and the centered orifice group in an adjacent valve row.

41. A bottoming device that forms a cross bottom paper bag, the device configured to form the cross bottom of the bag by providing folds at extremities of a tubular segment from which the bag is produced such that lines of an adhesive are applied to at least one of a folded bottom on the extremities of the tubular segment and a sheet to be adhered with the bottom, and to connect and adhere the folded bottom and the sheet, the bottoming device comprising an adhesive application head including a plurality of valves each having a plurality of adhesive output orifices through which the adhesive is directly applied under a higher-than-ambient pressure to the at least one of the folded bottom and the sheet in a contact-free manner, the valves being arranged in a configuration that includes a plurality of valve rows (VRi to VRn) each extending along a length of the application head in a direction (y) that is transverse to a bag transfer direction (x), with each of the valve rows including a plurality of valves (Vi to Vn) arranged along a length of the valve row, and an adhesive circulation channel that provides for continuous circulation of the adhesive within the adhesive application head, the adhesive circulation channel including (i) a first transverse channel and a second transverse channel each extending along the length of the application head in the (y) direction, and (ii) a connection channel extending across the application head in the (x) direction, the connection channel connecting an end of the first transverse channel to an adjacent end of the second transverse channel, the adhesive circulation channel providing for adhesive flow through the first transverse channel, across the connection channel, and through the second transverse channel to drain from the application head.

* * * * *